US005533553A

United States Patent [19]

Vesborg

[11] Patent Number: 5,533,553

[45] Date of Patent: Jul. 9, 1996

[54] CONTAINER SET COMPRISING AT LEAST TWO CONTAINERS

[75] Inventor: Steen Vesborg, Gentofte, Denmark

[73] Assignee: Colgate-Palmolive Co., New York, N.Y.

[21] Appl. No.: 186,722

[22] Filed: Jan. 26, 1994

[51] Int. Cl.[6] ..... B65B 1/04; B65B 3/04

[52] U.S. Cl. ..... 141/319; 141/364; 141/366; 141/375

[58] Field of Search ..... 141/319, 320, 141/363, 364, 365, 366, 375; 215/DIG. 8; 222/567, 109, 111; 285/332, 345

[56] References Cited

U.S. PATENT DOCUMENTS

| | | | |
|---|---|---|---|
| 2,433,989 | 1/1948 | Hanser | 141/363 X |
| 2,543,724 | 2/1951 | Iwanowski | 141/363 X |
| 2,773,521 | 12/1956 | Persson | 141/319 X |
| 3,261,381 | 7/1966 | Roach | 141/319 X |
| 4,573,506 | 3/1986 | Paoletti | 141/719 X |
| 4,614,437 | 9/1986 | Buehler | 141/319 X |
| 4,773,560 | 9/1988 | Kitscher | 222/109 |
| 4,917,268 | 4/1990 | Campbell et al. | 222/109 |
| 5,285,824 | 2/1994 | Kristovic | 141/319 X |

FOREIGN PATENT DOCUMENTS

| | | |
|---|---|---|
| 0109704 | 5/1984 | European Pat. Off. . |
| 0230273 | 7/1987 | European Pat. Off. . |
| 0421539 | 4/1991 | European Pat. Off. . |
| 8811084 | 2/1990 | Germany . |
| 9004964 | 10/1991 | Germany . |

*Primary Examiner*—Henry J. Recla
*Assistant Examiner*—Steven O. Douglas
*Attorney, Agent, or Firm*—Michael J. McGreal; Murray M. Grill

[57] ABSTRACT

A container set comprises a first container (1) adapted to be reused by being refilled with the contents of a second container (2) containing a product of a volume not exceeding the volume of the first container. The two containers (1 and 2) comprise mouth parts (13, 7) with guide faces allowing a coupling together of the containers in a position in which said containers are mutually immovable in radial direction. Furthermore, the mouth parts (13, 7) of the containers (1, 2) comprise co-operating sealing faces preventing the contents from leaking into the surroundings when the coupled containers are manipulated in order to transfer the contents from the second container (2) to the first container (1).

13 Claims, 4 Drawing Sheets

CONTAINER SET COMPRISING AT LEAST TWO CONTAINERS

The invention relates to a container set comprising at least two containers, where a first container is adapted to be reused by way of being refilled with the contents of a second container containing a product of a volume not exceeding the volume of the first container, each of said containers comprising mouth parts with an opening portion allowing free passage of the contents when said containers are used.

BACKGROUND ART

It is often a problem to pour the contents from one container into another container without spilling. Especially liquid contents involve problems when the container from which the liquid is to be poured comprises soft walls because the pouring cannot be controlled when the user presses too hard on said soft walls. The pouring of other flowable products, such as powdered and granular products can, however, also involve problems or cause inconvenience, for instance in form of dust. The growing interest in delivering flowable products in very thin-walled containers being difficult to handle has created an increasing demand for refilling a re-usable container with the liquid product without problems, said re-usable container being easy and reliable to handle.

SUMMARY OF THE INVENTION

The object of the invention is to provide a container set of the above type which allows a filling of the contents of a container being difficult to handle into a re-usable container being easy to handle without spilling said contents.

In satisfaction of the foregoing object, the container set according to the invention is characterised in that the mouth parts of the first and the second container comprise guide means allowing a coupling together of said containers in a position in which said containers are mutually immovable at least in the radial direction and in which the opening portions allow a free passage of the contents from the first container into the second container, the mouth parts of said two coupled containers comprising co-operating anti-leak means preventing the contents from leaking into the surroundings at least during passage of said contents from the second container to said first container.

In this manner it is possible without spilling to fill the contents of the second container into the first container by proceeding according to the following procedure:

- placing the second container in an upright position,
- turning the first container, i.e. the re-usable container, upside down and causing the guide faces of the two containers to engage one another so as to enter the coupled position in which they are immovable in the radial direction,
- turning the two containers upside down while maintaining the coupled position in such a manner that the second container is on top,
- whereby the contents of the second container flows downwards into the first container,
- causing the second container to disengage the re-usable container, whereafter said re-usable container being easy to handle can be used for pouring out the contents.

While the contents of the second container flow into the re-usable container the anti-leak means prevent the contents from leaking into the surroundings.

According to the invention, the guide means of the container may comprise an outer guide face on the mouth part of one container, where said outer guide face co-operate in a guiding manner with an inner guide face on the mouth part of the other container, preferably one of the guide faces is positioned on a face tapered in the coupling direction of the containers. As a result, the containers are reliably guided into the coupled position in which they are fixed in radial direction. The tapering face may advantageously be of such a tapering that a self-sealing effect is obtained between the co-operating guide faces.

In connection with the above embodiment of the invention, the outer guide face may be formed by the apex of an external thread on the mouth part of the second container. As the second container in many cases comprises a neck with an external thread, it is possible to reduce the total height of the container by using the thread apexes as guide faces compared to the situation where separate guide faces are to be provided on said neck.

Moreover, according to the invention, the co-operating anti-leak means on the mouth parts of the containers may comprise co-operating sealing faces also preventing the contents from leaking into the surroundings during the passage from the first container into the second container. This embodiment of the invention has the advantage that liquid cannot leak into the surroundings irrespective of the orientation of the containers in their coupled position, i.e. liquid cannot leak either when the first container is on top while filled with liquid.

In connection with the above embodiment of the invention at least one of the sealing faces may be a tapered face. This embodiment of the invention is considered to be particularly advantageous, especially when a rather small tapering angle is used because then the two sealing faces are pressed sealingly against one another in the coupled position of the containers. Furthermore, the sealing faces and the guide faces on the two containers of this embodiment of the invention may advantageously be formed by the same faces.

Furthermore, according to the invention the two mouth parts may comprise co-operating fastening means for a detachable mutual fastening of the two containers in their coupled position. In this manner, the risk of the containers being inadvertently caused to disengage one another in their coupled position during the filling procedure has been eliminated.

According to the invention, the fastening means may be threads. This embodiment renders it possible to utilize the thread for a cap as fastening means of either the first container or the second container.

Furthermore, according to the invention the mouth parts of the two containers may comprise co-operating stop faces adapted to abut one another in the coupled position of the two containers and consequently defining said position in the axial direction.

Moreover, according to the invention the mouth part of the first container may comprise a circumferential wall, on the inner side of which the guide means of the first container is arranged, and the mouth part of the second container may comprise a circumferential outwardly extending wall, on the outer side of which the guide means of the second container is position.

Finally, according to the invention the circumferential wall of the mouth part of the first container may in connection with the above embodiment of the invention comprise an inwardly extending bottom wall at a lower end, said bottom wall continuing into a spout-forming, upwardly extending wall, and an opening to the interior of the container may be provided in the lower portion of the annular compartment formed by said three walls.

BRIEF DESCRIPTION OF DRAWING

The invention is explained in greater detail below with reference to the accompanying drawing, in which.

DESCRIPTION OF PREFERRED EMBODIMENTS

Figure 1:
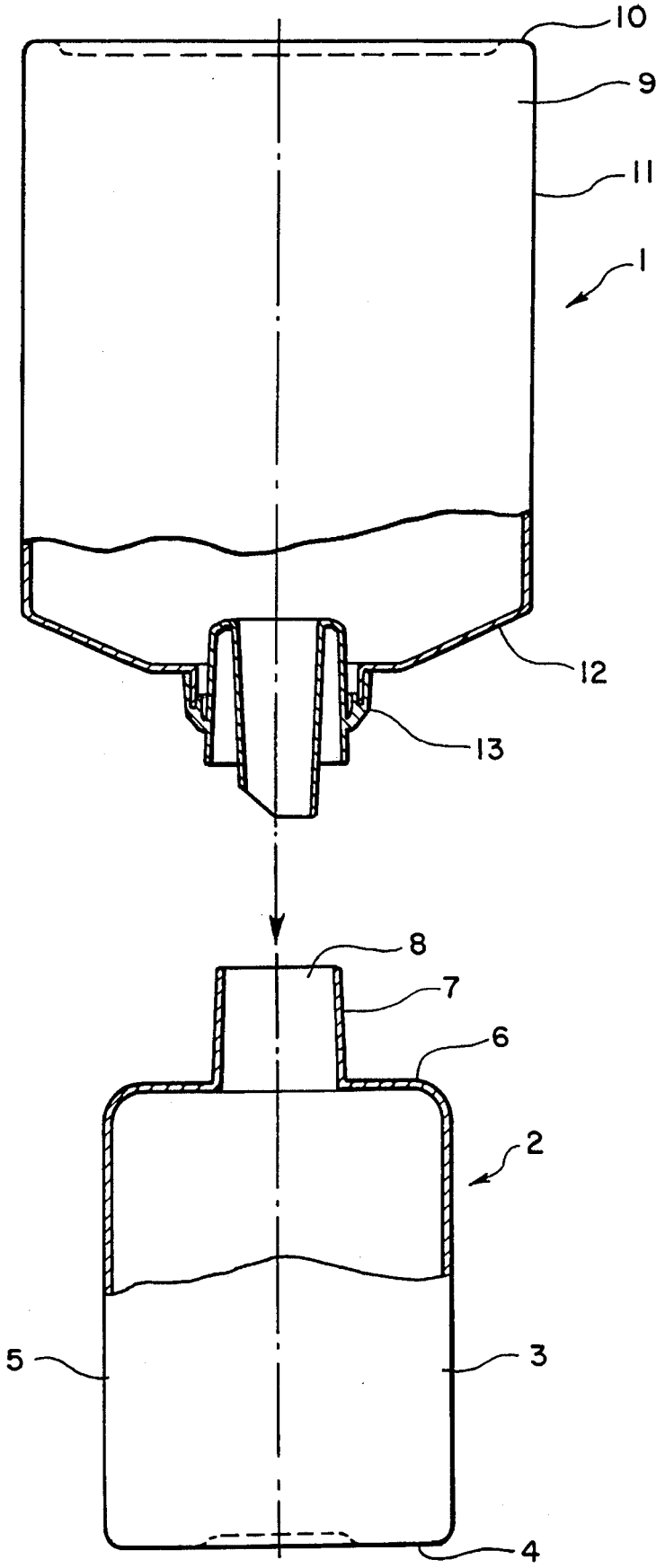
FIG. 1 is a diagrammatic side view, partly in section, of a container set according to the invention, FIG. 2 illustrate the containers of FIG. 1 in a coupled position and turned 180°.

FIG. 1 illustrates a container set comprising a first container 1 and a second container 2, where the first container is turned upside down and the second container is in the upright position. The first container is adapted to be re-used by being filled with the contents of the second container, which is a so-called disposable refill container. The second container 2 is of a smaller volume than the first container.

The second container 2 comprises a container body 3 formed by a bottom wall 4, a circumferential side wall 5, and an upper wall 6. A mouth part or neck 7 extends outwardly from the upper wall and defines a mouth opening 8. The second container 2 is preferably a very thin-walled plastic container and can for instance be produced by way of blow or injection moulding of polyethylene. The second container can, however, also be provided with a container body of plastic foil, cardboard, metal etc., a separate mouth part being arranged thereon.

The first container i comprises a container body 9 formed by a bottom wall 10, a circumferential side wall 11, and an upper wall 12. The upper wall 12 comprises a mouth part 13 defining an opening area 14 into the interior of the container.

As explained in greater detail below, the mouth part 7 of the second container comprises an outer conical surface adapted to guidingly and sealingly engage an inner conical surface on the mouth portion 13 of the first container 1. The coupled position of the two containers, in which their mouth portions 7 and 13 engage one another, is shown in FIG. 2, the coupling of the containers here being turned 180° relative to the position shown in FIG. 1.

Figure 2:
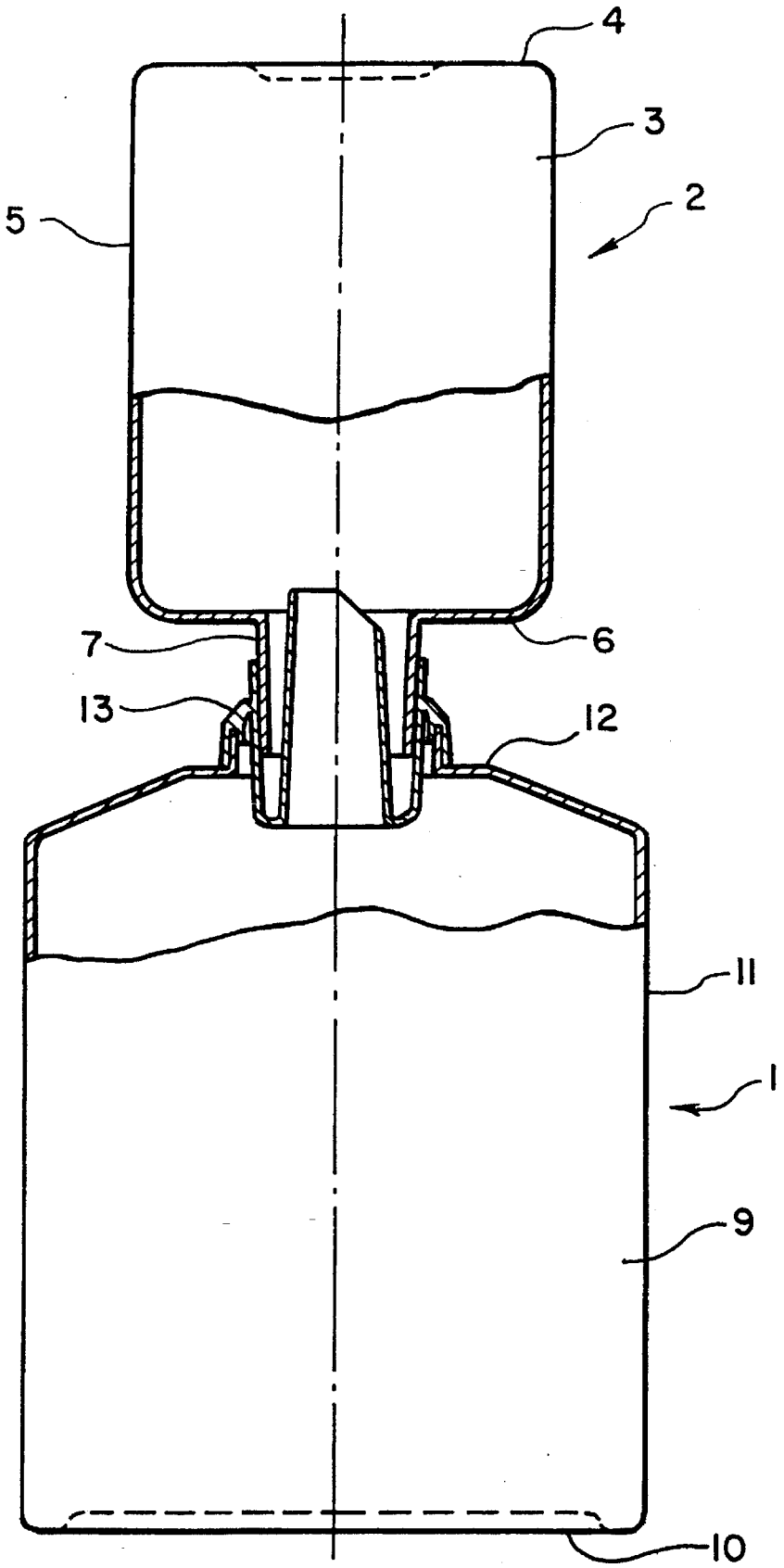

Reference is made to FIGS. 1 and 2, where the contents of the second container 2 is poured into the first container 1 by proceeding according to the following procedure:

The second container 2 is placed in an upright position, such as by standing on a plane base, the first container is taken to be emptied of its contents and it is placed upside down over the second container, the second container is approached the first container in such a manner that the mouth part 13 of the second container is caused to engage the mouth part 8 of the first container with the result that the containers enter a fixed position in radial direction relative to one another. By this embodiment of the invention the co-operating conical surfaces on the two mouth parts 8,13 provide the above radial fixing at the same time as they also define the coupling position in the axial direction, while maintaining the coupled position, the two containers are turned 180° so as to enter the position shown in FIG. 2, where the second container 2 is placed atop the first container. In this position, the contents of the second container 2 flow downwards into the first container 1, when the whole contents of the second container has passed into the first container, said second container is removed and the fist container can then be used for pouring the product contained therein.

Figure 3:
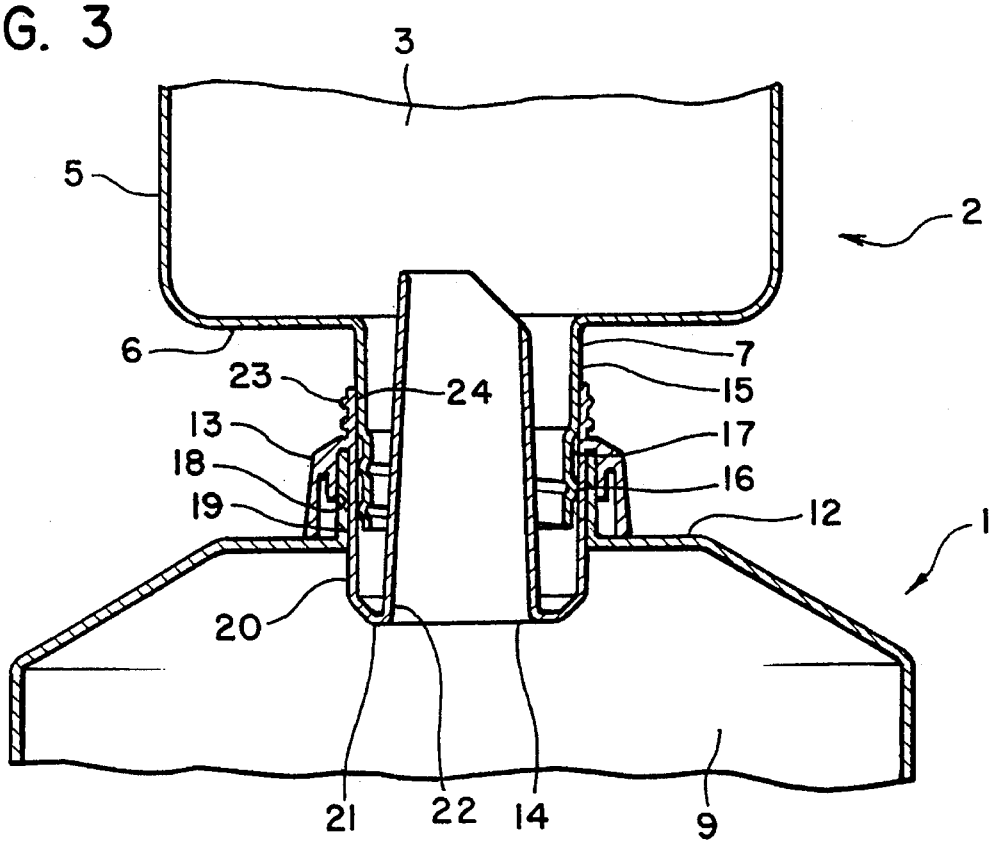
FIG. 3 illustrates on a larger scale the coupling area between the two containers of FIG. 2.

As clearly illustrated in FIG. 3, the neck 7 of the second container comprises a conical surface preferably of a tapering of ½ to 2°. The conical surface comprises an inner cone portion 15 formed by a closed face area and an outer cone portion 16 formed by the apexes of an external thread 17.

The mouth part 13 of the first container is formed by a separate part with a downwardly facing annular groove 18 permanently engaging a neck 19 on the container body 9. A circumferential wall 20 is positioned inside the neck 19 of the container body 9 and extends into the interior of the container. At a lower end the wall 20 continues into an inwardly extending bottom wall 21, which in turn continues into an upwardly extending inner wall 22 forming an pouring spout. The inner wall 22 is slotted over its entire length to form an opening extending to the bottom wall 22. At its upper end the circumferential wall 20 comprises an external thread 23 for screwing down a cap not shown on the first container 1.

The inner surface 24 of the circumferential wall 20 tapers inwardly by a tapering of ½ to 2° and forms a combined guiding and sealing face shown in a sealing and guiding engagement with the combined guiding and sealing face 15, 16 on the container 2.

In order to obtain a reliable mutual retaining of the two containers, the inner surface 24 of the circumferential wall 20 can be provided with an internal thread not shown, which is adapted to co-operate with the external thread 17 on the neck 7 of the second container. In this manner it is in addition to a locking engagement between the two containers also possible to obtain a high sealing force between said two sealing faces.

In FIG. 3 the neck 7 of the second container 2 is provided with a thread with the result that it can be closed by means of a cap. However, the neck may also be provided with a closing snap cap or be sealed by means of a terminal wall being cut off when the container is to be opened, which is known in connection with containers containing liquids for medical use.

Figure 4:
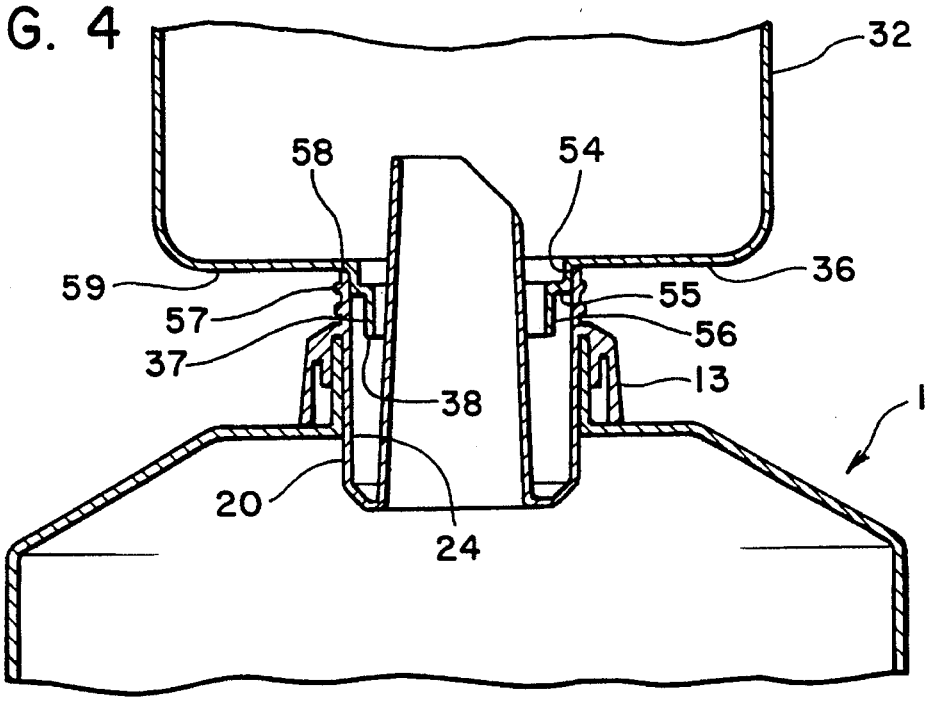
FIG. 4 is a sectional view through the coupling area of a second embodiment of the container set according to the invention.

FIG. 4 illustrates a container set, where the mouth part 13 of the first container 1 corresponds completely to the mouth part 13 described in connection with FIG. 3 and therefore not described in greater detail. The second container 32 corresponds to the second container 2 described in connection with FIG. 3 apart from the shape of its mouth part or neck 7. The mouth part 37 comprises an annular wall 56 extending outwardly from the upper wall 36 and defining the container opening 38. Adjacent the upper wall 36, the annular wall 56 comprises three radially outwardly extending projections 55, only one projection appearing from FIG. 4. The outer surfaces 57 of the outer walls 54 of the projections 55 form a guide means and are arranged on a cone face tapering like the inner surface 24 on the first container 1. Thus the surfaces 24 and 57 of the walls 20 and 54 serve as guide faces guiding the two containers into their radially locked, coupled position. The circumferential wall 20 comprises an upper edge 58. The abutment of this edge 58 against the upper surface 59 of the upper wall 36 of the second container 32 defines the coupled position of the two containers in axial direction. The abutment between the two faces can simultaneously have a sealing purpose when the two faces are shaped as sealing faces.

Figure 5:
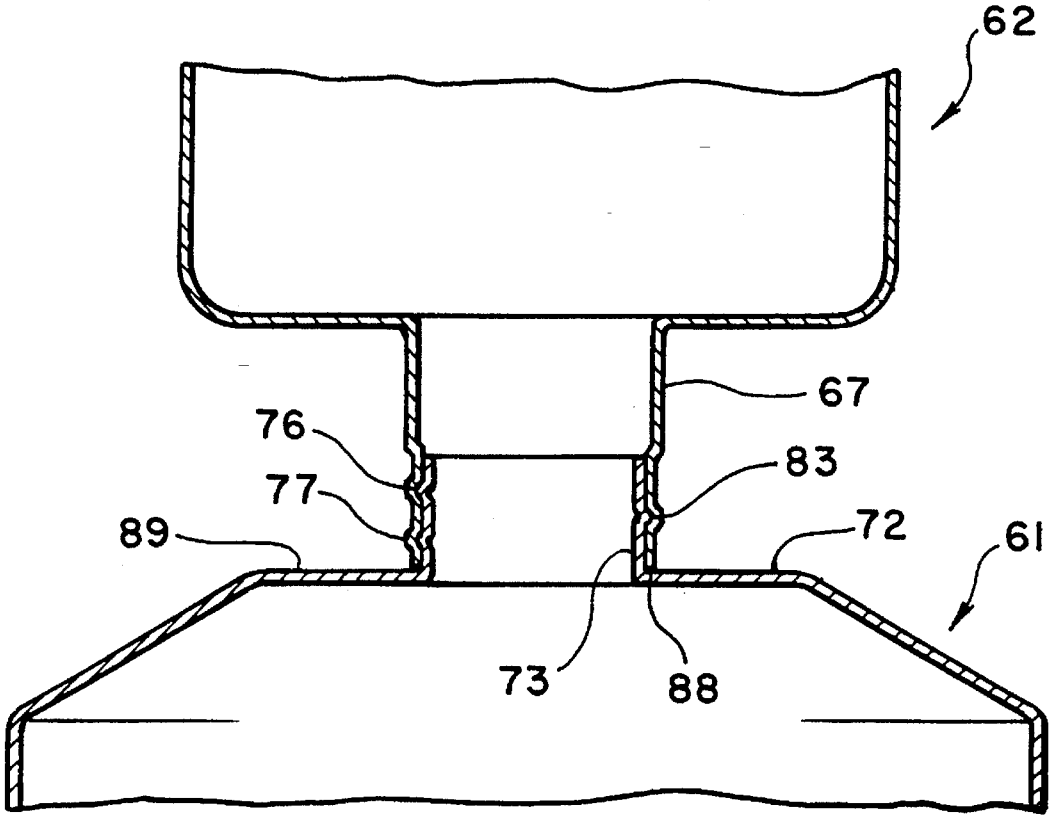
FIG. 5 is a sectional view through the coupling area of a third embodiment of the container set according to the invention.

The embodiment of FIG. 5 comprises a second container 62 with a mouth part 67 provided with both an internal thread 76 and an external thread 77, the apexes of the threads of the external thread being arranged like the apexes of the internal thread, and vice versa. The external thread 77 serves to screw down a screw cap not shown, whereas the internal thread 76 is adapted to engage an external thread 83 on a mouth part 73 of the first container 61. The engagement of the internal thread 76 of the second container 62 and the external thread 63 of the first container provides a reliable interlocking of the two containers. The threads serve simultaneously as guide faces. When the internal thread 76 of the second container 62 is completely screwed down on the external thread 73 of the first container 61, the edge 88 of the mouth part 67 abuts the upper surface 89 of the upper wall 72 of the first container 61. The co-operating surfaces 88 and 89 can serve as sealing faces and define the coupled position of the two containers 61, 62 in the axial direction.

I claim:

1. A container set comprising at least two containers, where a first container is adapted to be reused by way of being refilled with the contents of a second container containing a product of a volume not exceeding the volume of the first container, each of said containers comprising mouth parts with an opening portion allowing free passage of the contents when said containers are used, wherein the first and the second container comprise guide means allowing a coupling together of said containers to a position, in which said containers are mutually immovable at least in the radial direction and in which the opening portions allow a free passage of the contents from the first container into the second container, the mouth parts of said first and second coupled containers comprising cooperating fastening means, guide means and anti-leak seal means wherein said cooperating fastening means comprise detachably fastening the first and second containers to one another in their coupled position and said cooperating anti-leak means comprise cooperating sealing faces wherein at least one of the sealing faces is a tapered face thereby preventing the contents from leaking into the surroundings at least during passage of said contents from the second container to said first container.

2. A container set as in claim 1, wherein the mouth of said first container has an internal and an external thread thereon, said internal and external threads being arranged in a cooperating structure, wherein the apex of one of said threads forms a part of an other thread.

3. A container set as in claim 1, wherein the fastening means are threads.

4. A container set as in claim 1, wherein the mouth parts of the first and second containers comprise cooperating stop faces adapted to abut one another in the coupled position of the first and second containers and thereby define said position in the axial direction.

5. A container set as in claim 1, wherein the mouth part of the first container comprises a circumferential wall, on the inner side of which the guide means of the first container is arranged, and that the mouth part of the second container comprises a circumferential outwardly extending wall, on the outer side of which the guide means of the second container is arranged.

6. A container set as in claims 1 wherein the mouth part of the second container is threaded and an outer surface of the mouth part is formed by the apexes of the external thread on the mouth part of the second container.

7. A container set comprising at least two containers, where a first container is adapted to be reused by way of being refilled with the contents of a second container containing a product of a volume not exceeding the volume of the first container, each of said containers comprising mouth parts with an opening allowing free passage of the contents when said containers are used, wherein the first container and the second container have guide means allowing a coupling together of said first and second containers to a position in which said containers are mutually immovable at least in the radial direction and in which the opening portions allow a free passage of the contents from the first container into the second container, the mouth parts of said coupled first and second containers comprising cooperating anti-leak means preventing the contents from leaking into the surroundings at least during passage of said contents from the second container to said first container, wherein the mouth part of the first container comprises a circumferential outwardly extending wall on the inner surface of which the cooperating guide means and anti-leak means of the first container are arranged, and that the mouth part of the second container comprises a circumferential outwardly extending wall, on the outer surface of which the cooperating guide means and anti-leak means of the second container are arranged, at least one of said inner surface or outer surface being tapered, wherein the circumferential wall of the mouth part of the first container further comprises at a lower end, an inwardly extending bottom wall continuing into a spout-forming, upwardly extending wall, and that an opening into the interior of the container is provided in the lower portion of an annular compartment formed by the circumferential wall, bottom wall and upwardly extending wall.

8. A container set as in claim 7, wherein there are threads on the outer side of the mouth part of the second container the outer side is formed by the apexes of external threads on the mouth part of the second container.

9. A container set as in claim 7, wherein the mouth parts of the first and second containers comprise cooperating fastening means detachably fastening the first and second containers to one another in their coupled position.

10. A container set as in claim 9, wherein the fastening means are threads.

11. A container set as in claim 7, wherein the mouth parts of the two containers comprise cooperating stop faces adapted to abut one another in the coupled position of the first and second containers and thereby define said position in the axial direction.

12. A container set as in claim 7, wherein the mouth of said first container has an internal and an external thread thereon, said internal and external threads being arranged in a cooperating structure, wherein the apex of one of said threads forms a part of an other thread.

13. A container set comprising at least two containers, where a first container is adapted to be reused by way of being refilled with the contents of a second container containing a product of a volume not exceeding the volume of the first container, each of said containers comprising mouth parts with an opening portion allowing free passage of the contents when said containers are used, wherein the first and the second container comprise guide means allowing a coupling together of said containers to a position, in which said containers are mutually immovable at least in the radial direction and in which the opening portions allow a free passage of the contents from the first container into the second container, the mouth parts of said first and second coupled containers comprising cooperating anti-leak seal means preventing the contents from leaking into the surroundings at least during passage of said contents from the second container to said first container, the mouth of said first container having an internal and external thread thereon, said threads being arranged in a cooperating structure, wherein the apex of each said thread forms a part of the other thread.

* * * * *